United States Patent [19]

Gerdes

[11] Patent Number: 4,799,415

[45] Date of Patent: Jan. 24, 1989

[54] SUPPORT FOR STOCK IN A CUTTER

[75] Inventor: Erwin Gerdes, Edewecht/Portsloge, Fed. Rep. of Germany

[73] Assignee: MBB GmbH, Bremen, Fed. Rep. of Germany

[21] Appl. No.: 905,704

[22] Filed: Sep. 9, 1986

[30] Foreign Application Priority Data

Sep. 25, 1985 [DE] Fed. Rep. of Germany ..... 3534096

[51] Int. Cl.[4] ..... B26F 3/00

[52] U.S. Cl. ..... 83/177; 83/53; 83/155; 83/435.2; 198/848

[58] Field of Search ..... 83/177, 53, 155, 435.2; 198/849, 848, 844, 845, 850

[56] References Cited

U.S. PATENT DOCUMENTS 973,597 10/1910 Wedge ..... 198/848 X 2,037,904 4/1936 Hogg ..... 198/849

2,234,537 3/1941 Blackburn ..... 198/849 X 2,278,361 3/1942 Rapisarda ..... 198/849 X 3,161,155 12/1964 Orlandi ..... 198/848 X 3,526,162 9/1970 Willcox ..... 83/177 X 3,889,803 6/1975 White ..... 198/845 X

*Primary Examiner*—Frank T. Yost

*Attorney, Agent, or Firm*—Ralf H. Siegemund

[57] ABSTRACT

In an apparatus for cutting flat stock such as foil, strip, fiber-reinforced ribbons, or the like, a support structure for the stock to be cut includes two endless chains running parallel to each other at a fixed distance from each other; the chain link members are provided each with holding elements for uniformly distributed pins; steel strips or wires loop around the pins and extend across the space between the two chains establishing a support surface for flat stock, the strips or wires are oriented so that respective thin edges face a cutting tool.

6 Claims, 3 Drawing Sheets

SUPPORT FOR STOCK IN A CUTTER

BACKGROUND OF THE INVENTION

The present invention relates to the cutting of flat blanks such as foil or flat fiber-reinforced, compound material, under utilization of a digitally controlled movable high pressure cutting nozzle, ejecting a jet penetrating stock on that table, or other suitable cutting device.

DESCRIPTION OF THE INVENTION

It is an optional combinatory feature of the present invention, in the case of a liquid jet cutter, to provide a capturing container underneath the cutting table for capturing the jet following the penetration of the cut stock, and to have the container follow the movement of the cutting jet ejecting nozzle.

It is an object of the present invention to provide a cutting table for automatic disposition of the blank of stock to be cut.

It is a particular feature of the present invention to provide a cutting table for liquid jet cutting that will offer minimal obstacle action, i.e. that does not impede the jet, deflect it or the like.

In accordance with the preferred embodiment of the present invention, it is suggested to construct the cutting table from two equidistantly spaced, endless chains, which are run around rollers, wherein the chain members (link members), each have holder-like extensions carrying several uniformly distributed pins; the holder-like extension has, e.g., one end of a thin steel strip fastened thereto, which strip meanders around the pins of that extension and the pins on a chain member extension pertaining to the other chain.

It is basically optional to have both ends of each strip fastened to the same chain member extension, or whether one end is fastened to one member extension, the other end to a member extension of the other chain. The two chains each are held in particular spatial relation to a rail; there are two rails accordingly which thus hold the two chains in a particular position to each other such that all the steel strips (or wires) are held in tension. The cutter is disposed above the upper stringer of this endless circulating table.

The inventive cutting table makes sure that the meandering intensioned steel strip establishes the principle support for the stock to be cut, while the high pressure liquidous cutting jet can penetrate this table practically without impediment. This means that, in fact, the cutting nozzle can be disposed vis-a-vis the cutting table in any desirable position, so that the stock as placed on this table, is subject only to insignificant limitations as to possible and feasable dispositions as far as cutting location is concerned. The cutting device, including the novel cutting table, can be used, for example, in any stage of an assembly line production, because there are no difficulties on account of the table construction concerning the feeding of stock to the table and transfer process stock therefrom.

DESCRIPTION OF THE DRAWINGS

While the specification concludes with claims, particularly pointing out and distinctly claiming the subject matter which is regarded as the invention, it is believed that the invention, the objects and features of the invention, and further objects, features, and advantages thereof will be better understood from the following description taken in connection with the accompanying drawings, in which:

Figure 1:
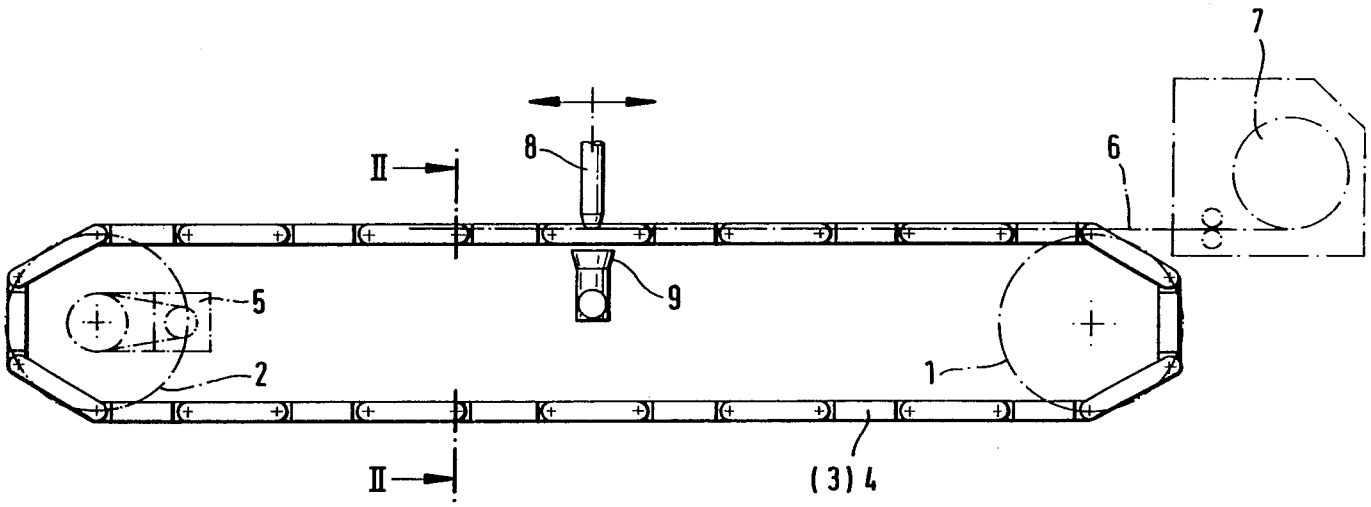
FIG. 1 illustrates in principle a cutting device with endless chains for and as part of the cutting table in accordance with the preferred embodiment of the present invention for practicing the best mode thereof.

Proceeding now to the detailed description of the drawings, the cutting table is basically comprised of two endless chains 3 and 4, which are looping around rollers 1 and 2. The roller 2, in this case, is driven by a motor 5 while roller 1 is just a deflection pully and thus idles. Reference numeral 6 refers by way of example to stock that is to be cut, for example, it is a ribbon or strip wound from a spool 7 and moved by engagement with the chains 3 and 4. Reference numeral 8 refers to a cutting nozzle which is not the subject of this invention. Suffice it to say, the nozzle is disposed above the upper stringer of the endless, circulating table and ejects a liquidous jet 18 under high pressure in down direction. During cutting, a liquid catching container 9 captures the jet following penetration of the cable, and it follows the movement of the nozzle, either through a common mounting arrangement or dynamically through follow-up control.

Basically, nozzle 8 and capturing container 9 are movable in two dimensions, that means in direction of the double arrow indicated in FIG. 1, as well as transverse to the plane of the drawing of FIG. 1. However, in simple cases, there may only be a transverse nozzle movement as far as the plane of the drawing of FIG. 1 is concerned, e.g. to just cut across the ribbon or strip 6. In this case, then, the longitudinal motion is provided by motion of the chains and pulling of the stock 6 off, the spool 7. The spool 7 does not have to be driven, because, as will be shown shortly, the strip 6 is in engagement with the chains and is forced to follow any movement thereof, so that the principle movement and motive force in longitudinal direction is provided by the drive 5.

Figure 2:
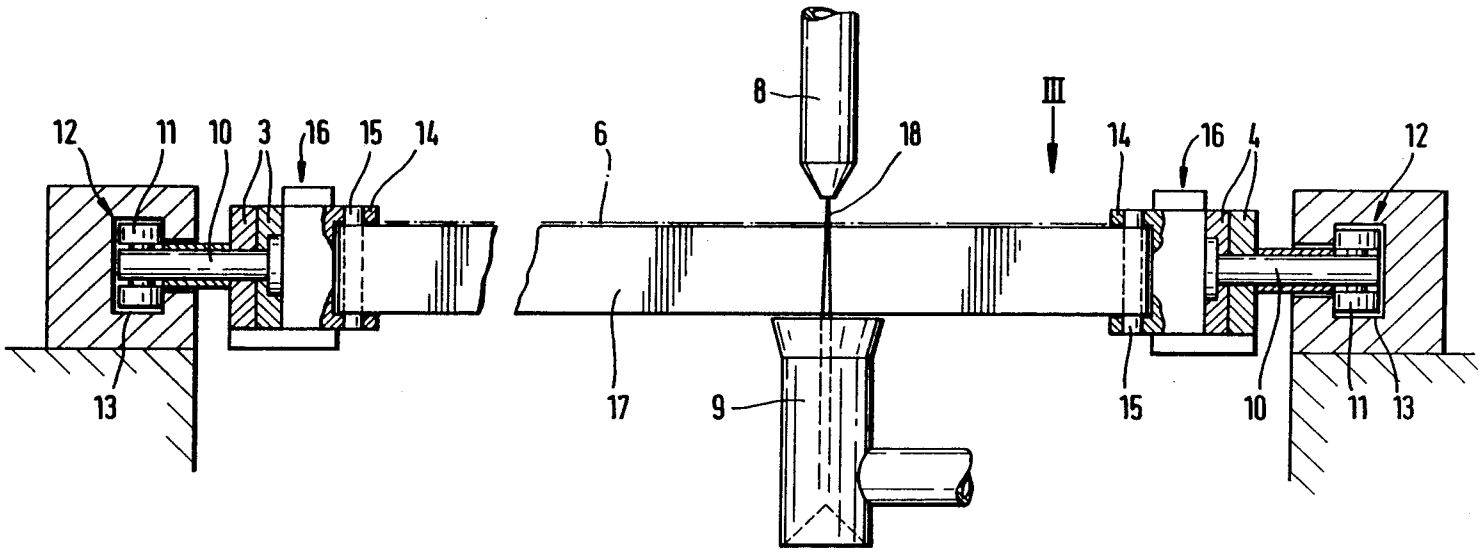
FIG. 2 is an enlarged section view indicated by II—II in FIG. 1.

As shown in FIG. 2, the chain link members of the chain 3 and 4, are interconnected through outwardly extending pins 10, and respectively two rollers 11 are provided at the projecting ends of these pins. These rollers 11, in turn, engage a guide rail 13. There are accordingly two stationary positioned guide rail elements 13, one for each chain. Each of them has a T-shaped guide groove in which the rollers 11 run.

The two guide rail elements 13 have a definite and fixed position in relation to each other, and their spacing determines the disposition of the two chains, so that each of these chains run in an accurately determined guide path in relation to the respective elements 13, and the two chains 3 and 4 taken together will run, and be spaced accurately in relation to each other. This is significant for reasons of the construction of the supporting plot of the table.

Figure 3:
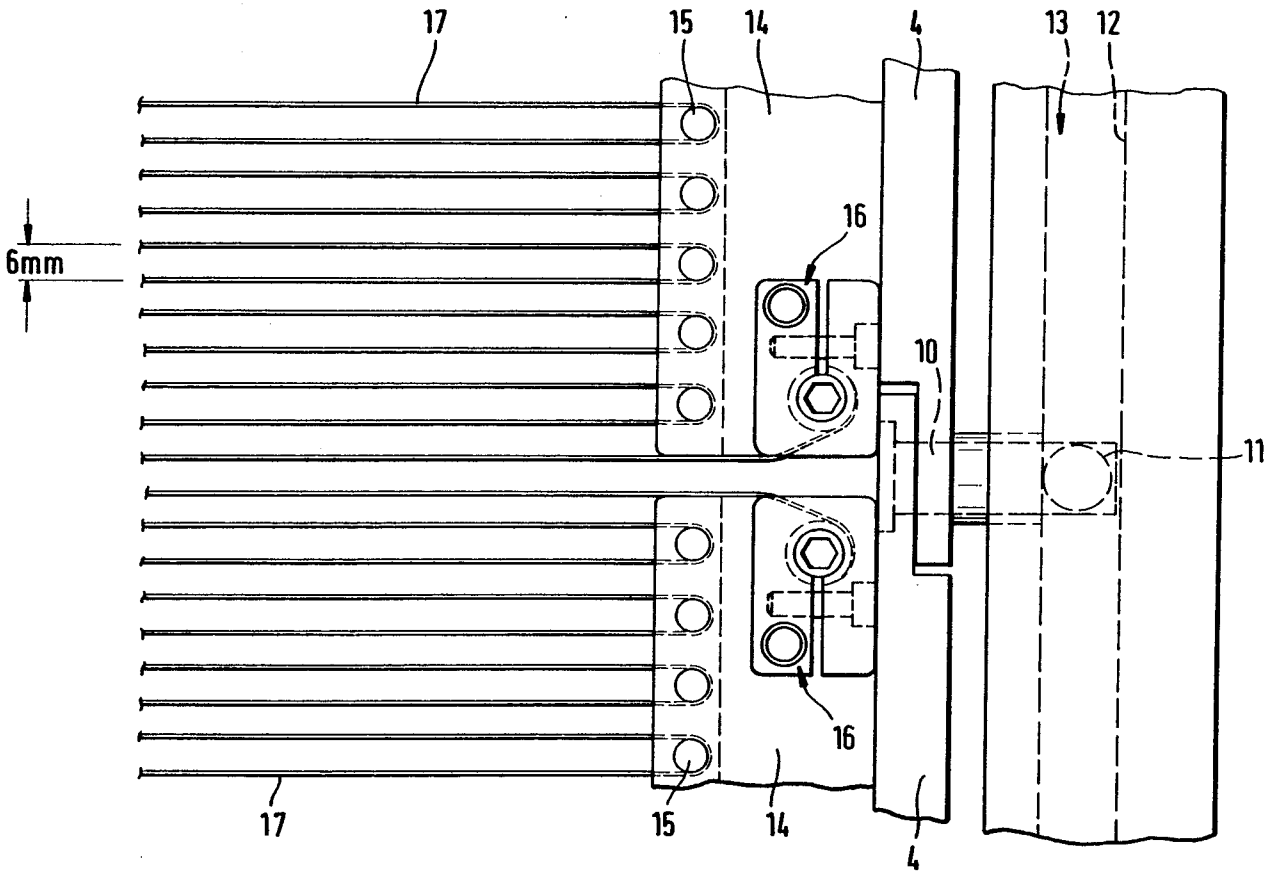
FIG. 3 is a still further enlarged detailed top elevation, indicated by III in FIG. 2.

The flat, chain link members are, as shown in FIGS. 2, each provided with a holder 14, being a lateral extension of a chain element. These holders 14 are each provided with and cary a plurality of upright pins 15. Moreover, each of these holders 14 is provided with at least one clamping and tensioning structure 16. A steel strip 17 loops around the pins 15 of a holder 14; there is one strip per chain link member and holder, for example, of one chain 4, such as illustrated in FIG. 3. That strip 17 traverses the spacing between the two chains and is then looped around the corresponding pins 15 of a holder on a member of the chain 3. Hence, two members of the two chains are interconnected, so to speak, by this steel strip 17, meandering back and forth across the space between the two chains. There are accordingly, then, as many steel strips as there are members in a chain. Both ends of a strip may be fastened to the same chain member holder or one end may be fastened to a holder on a member of chain 3, the other end to a holder or a member of chain 4. This group of steel strips 17 establishes the table. Each steel strip 17, as shown in FIG. 3, can be interpreted also as a simple wire. The configuration and representation as per FIG. 3 will be the same. Utilization of a wire, instead of a strip, was mentioned earlier.

The chains, of course, run in a direction which extends transversely to the predominant direction of the extension of the steel strips, and the steel strips have their thin edges face up and down. The steel strips 17 are preferably made of stainless steel with a thickness of 1/10 to 0.3 millimeter, and a width of about 30 millimeter. The width dimension, of course, extends in the direction of the cutting jet, and it is that very thin edge of the strip that faces the cutting jet. Therefore, this strip offers practically no impediment to the uncoming jet. The distance of the pins 15 in each of the holders 14 is roughly twice the diameter of the pin diameter, and is preferably about 6 millimeter.

The inventive structure permits an automatic disposition of stock being paid off a supply spool 7 towards and onto the circulating table. The chains as stated, are actively maintained in a particular distance from each other which, in turn, of course, is directly instrumental in keeping the steel strips 17 under tension, and, therefore, sufficiently stiff. Thus, cutting with a liquid jet 18 from the nozzle 8 poses no problem. This, however, is also true for other types of cutters, such as laser, pneumatic, or steam nozzle cutting. The inventive structure, therefore, can be easily inserted in an automated continuous production line. It also is possible to replace the steel strip with steel wire, or a strip or wire of suitable tensionable and sufficiently strong material.

The invention is not limited to the embodiments described above, but all changes and modifications thereof, not constituting departures from the spirit and scope of the invention, are intended to be included.

What is claimed is:

1. In an apparatus for cutting flat stock such as foil, strip, fiber-reinforced ribbons, or the like, a support structure for the stock to be cut comprising:

two endless chains running parallel to each other;

means for maintaining said chains at a predetermined distance from each other;

said chains having chain link members, each member being provided with at least one holding element;

a plurality of pins uniformly distributed on the holding elements; and a plurality of thin flexible elongated elements such as strips or wires, each of the elements looping around a plurality of said pins and extending from a holding element on a chain link member of one of the chains, to a holding element on a chain link member of the other chain and back to a further holding element on the member of the one chain, thereby spanning a distance between the two chains, said all elements together establishing a support surface for flat stock, the element strips or wires oriented so that respective thinnest dimensions face a cutting tool.

2. The support as in claim 1, the chain link members each provide with laterally extending pins, carrying guide rollers, said means for maintaining the distance, including stationary rails with a groove, said rollers running in said groove, and thereby maintaining said chain in particular disposition relative to the groove and thereby maintaining the distance between the chains corresponding to the distance between said rails.

3. The device as in claim 1, wherein said elements are stainless steel strips, having a thickness of about 0.1—0.3 millimeter, and a width somewhat larger than an inch.

4. The device as in claim 1, wherein said pins on said holding members have a distance from each other approximately twice the diameter of the pins.

5. The device as in claim 1, wherein said elements are made of wire.

6. The support as in claim 1, in combination with a high pressure cutting nozzle, and a capturing container underneath, said capturing container being maintained in a fixed position relative to the cutting nozzle, the nozzle in the capturing container being respectively placed above and below the upper stringer of the chains.

* * * * *